US011912455B2

(12) United States Patent
Dodson et al.

(10) Patent No.: US 11,912,455 B2
(45) Date of Patent: Feb. 27, 2024

(54) SYSTEM, METHOD AND APPARATUS FOR PROCESSING CARTRIDGES EN MASSE

(71) Applicant: Gravitron, LLC, Austin, TX (US)

(72) Inventors: Travis Dodson, Austin, TX (US); Micah Evans, Austin, TX (US)

(73) Assignee: Gravitron, LLC, Austin, TX (US)

( * ) Notice: Subject to any disclaimer, the term of this patent is extended or adjusted under 35 U.S.C. 154(b) by 0 days.

(21) Appl. No.: 17/161,282

(22) Filed: Jan. 28, 2021

(65) Prior Publication Data

US 2021/0147104 A1 May 20, 2021

Related U.S. Application Data

(60) Continuation of application No. 16/834,366, filed on Mar. 30, 2020, now abandoned, which is a division of (Continued)

(51) Int. Cl.
*B65B 67/02* (2006.01)
*B65B 1/06* (2006.01)

(Continued)

(52) U.S. Cl.
CPC ..... *B65B 67/02* (2013.01); *B65B 1/06* (2013.01); *B65B 1/24* (2013.01); *B65B 7/2821* (2013.01);

(Continued)

(58) Field of Classification Search
CPC .. B65B 67/02; B65B 1/06; B65B 1/24; B65B 7/2821; B65B 39/00; B65B 39/007; B65B 39/06; B65B 7/00; B65B 7/16; B65B 7/28

(Continued)

(56) References Cited

U.S. PATENT DOCUMENTS 2,155,336 A * 4/1939 Smith ..... B65B 1/36 141/378
3,552,454 A * 1/1971 Deming, Sr. ..... B65B 1/24 141/237

(Continued)

FOREIGN PATENT DOCUMENTS

FR 3022533 A1 12/2015
WO 9962764 A2 12/1999

OTHER PUBLICATIONS

Manual Capsule Filling machine KI-MCF300 "https://www.youtube.com/watch?v=FLXmiUmcQog" by Kahan International (published Jul. 2, 2016 and accessed Oct. 21, 2021 Published on Youtube.com (Year: 2016).*

(Continued)

*Primary Examiner* — Gloria R Weeks
*Assistant Examiner* — Mobeen Ahmed
(74) *Attorney, Agent, or Firm* — Dickinson Wright PLLC

(57) ABSTRACT

A cartridge processing system can have a base to support cartridges on an underlying support surface. The base can include a rack with support holes to support respective ones of the cartridges. In addition, a tray having a tray bottom can be removably placed on tops of the cartridges. A platform with platform holes can be substantially coaxially aligned with respective ones of the support holes. The tray can have a funnel extending from the platform. The funnel can form a perimeter around the platform holes, such that the platform holes can be conduits for product to be placed in the cartridges.

9 Claims, 19 Drawing Sheets

Related U.S. Application Data application No. 16/565,869, filed on Sep. 10, 2019, now Pat. No. 10,604,292.

(60) Provisional application No. 62/807,942, filed on Feb. 20, 2019.

(51) Int. Cl.

| | |
|---|---|
| ***B65B 1/24*** | (2006.01) |
| ***B65B 7/28*** | (2006.01) |
| ***B65B 39/00*** | (2006.01) |
| ***B65B 39/06*** | (2006.01) |

(52) U.S. Cl.
CPC ..... *B65B 39/00* (2013.01); *B65B 39/007* (2013.01); *B65B 39/06* (2013.01)

(58) Field of Classification Search
USPC ..... 53/527, 268, 281, 284, 284.5, 299, 319, 53/324, 328, 390, 467, 471, 473; 141/237–240, 247, 391, 331–345
See application file for complete search history.

(56) References Cited

U.S. PATENT DOCUMENTS 3,921,681 A * 11/1975 Rebmann ..... A61J 3/074 141/71
4,040,234 A * 8/1977 Stockdale ..... B01L 9/06 53/421
4,068,449 A * 1/1978 Harper ..... B65B 7/2842 53/328
4,827,827 A * 5/1989 Sanfilippo ..... F42B 33/0292 222/572
4,877,067 A * 10/1989 Shimokawa ..... B65B 39/002 141/147
4,884,602 A * 12/1989 Yamamoto ..... B65B 1/36 141/238
4,972,886 A * 11/1990 Bernstein ..... F25C 5/20 141/237
5,081,822 A * 1/1992 Boyd ..... A61J 3/074 53/485
5,321,932 A * 6/1994 Sundberg ..... A61J 3/075 53/900
5,519,984 A * 5/1996 Beussink ..... B65B 3/003 53/489
7,234,494 B2 * 6/2007 Tahil ..... A61J 3/075 141/237
7,337,596 B2 * 3/2008 Barrett ..... B65B 35/56 53/900
7,530,213 B2 * 5/2009 Barrett ..... A61J 3/075 53/900
8,955,563 B2 * 2/2015 Tahil ..... A61J 3/075 141/237
9,456,957 B2 * 10/2016 Tahil ..... A61J 3/074
9,862,519 B2 * 1/2018 Deutschle ..... B65D 85/42
10,071,021 B2 * 9/2018 Calvert, II ..... A61J 3/074
2001/0035431 A1 * 11/2001 Runft ..... A61J 3/074 141/81
2001/0043972 A1 * 11/2001 Tomlinson ..... B65B 1/06 426/115
2003/0215956 A1 * 11/2003 Reed ..... B01L 3/50255 422/400
2005/0076969 A1 * 4/2005 Tahil ..... A61J 3/075 141/165
2006/0248857 A1 * 11/2006 Senesi ..... A61J 3/075 53/281
2007/0130890 A1 * 6/2007 Barrett ..... A61J 3/075 53/900
2008/0216312 A1 * 9/2008 Williams ..... B65B 7/2821 29/773
2009/0288375 A1 * 11/2009 Pagani ..... B65B 19/34 53/236
2011/0094189 A1 * 4/2011 Bottger ..... A61J 1/2093 206/524.1
2011/0259467 A1 * 10/2011 Maness ..... A61B 90/98 141/391
2013/0014471 A1 * 1/2013 Tahil ..... A61J 3/074 53/284.5
2013/0068348 A1 * 3/2013 Sanchez ..... B65B 39/007 141/331
2014/0299227 A1 * 10/2014 Dix ..... B65B 39/12 141/11
2015/0122693 A1 * 5/2015 Deutschle ..... B65D 1/36 53/471
2015/0166217 A1 * 6/2015 Deutschle ..... B65B 7/28 53/425
2016/0089205 A1 * 3/2016 Liversidge ..... A61J 1/00 53/473
2016/0200461 A1 * 7/2016 Broadbent ..... B65B 55/027 53/426
2016/0318229 A1 * 11/2016 Drzewiecki ..... B65B 7/16
2018/0134423 A1 * 5/2018 Narvekar ..... B65B 43/59
2019/0127102 A1 * 5/2019 Chudy ..... B65B 7/2871
2020/0015516 A1 * 1/2020 Simpson ..... A24C 5/01
2020/0156811 A1 * 5/2020 Milandri ..... B65B 1/363

OTHER PUBLICATIONS

European Patent Office, Extended European Search Report dated Jul. 1, 2020 for European Patent Application No. 19207649.5, seven pages.

* cited by examiner

SYSTEM, METHOD AND APPARATUS FOR PROCESSING CARTRIDGES EN MASSE

CROSS-REFERENCE TO RELATED APPLICATIONS

This application is a continuation of and claims priority to and the benefit of U.S. patent application Ser. No. 16/834,366, filed Mar. 30, 2020, which is a division of U.S. patent application Ser. No. 16/565,869, filed Sep. 10, 2019, which claims priority to and the benefit of U.S. Prov. Pat. App. No. 62/807,942, filed Feb. 20, 2019. The contents of the above-referenced applications are incorporated herein by reference in their entirety.

TECHNICAL FIELD

This application generally relates to handling containers for product and, in particular, to a system, method and apparatus for manually processing cartridges en masse.

STATEMENT OF FEDERALLY FUNDED RESEARCH

None.

BACKGROUND OF THE DISCLOSURE

Manually loading products into containers can be challenging and time consuming. For example, accurately loading loose and particulate-type products into small containers by hand can be particularly cumbersome. Although existing designs and methods are workable, improvements in loading containers with product continue to be of interest.

SUMMARY OF THE DISCLOSURE

Embodiments of a system, method and apparatus for cartridge processing are disclosed. For example, versions can include a cartridge processing system having a base configured to support cartridges on an underlying support surface. The base can include a rack with support holes configured to support respective ones of the cartridges. In addition, a tray comprising a tray bottom can be configured to be removably placed on tops of and, in some examples, supported by all of, the cartridges. A platform with platform holes can be configured to be substantially coaxially aligned with respective ones of the support holes. The tray can have a funnel extending from the platform. The funnel can form a perimeter around the platform holes, such that the platform holes are configured to be conduits for product to be placed in the cartridges.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

For a detailed description of example embodiments, reference will now be made to the accompanying drawings in which.

DEFINITIONS

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
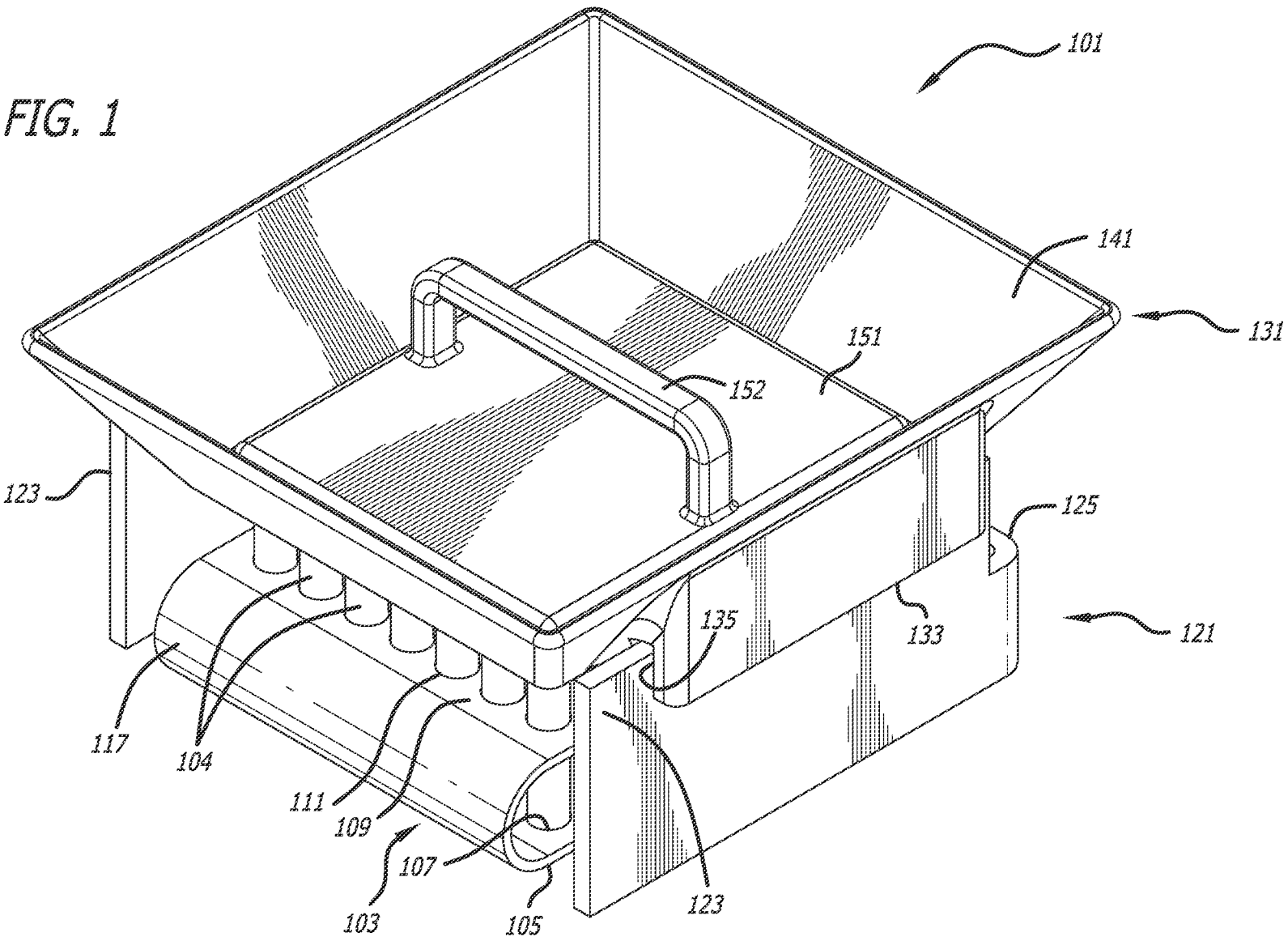
FIG. 1 is a perspective view of an embodiment of a cartridge processing system, shown assembled.
Figure 2:
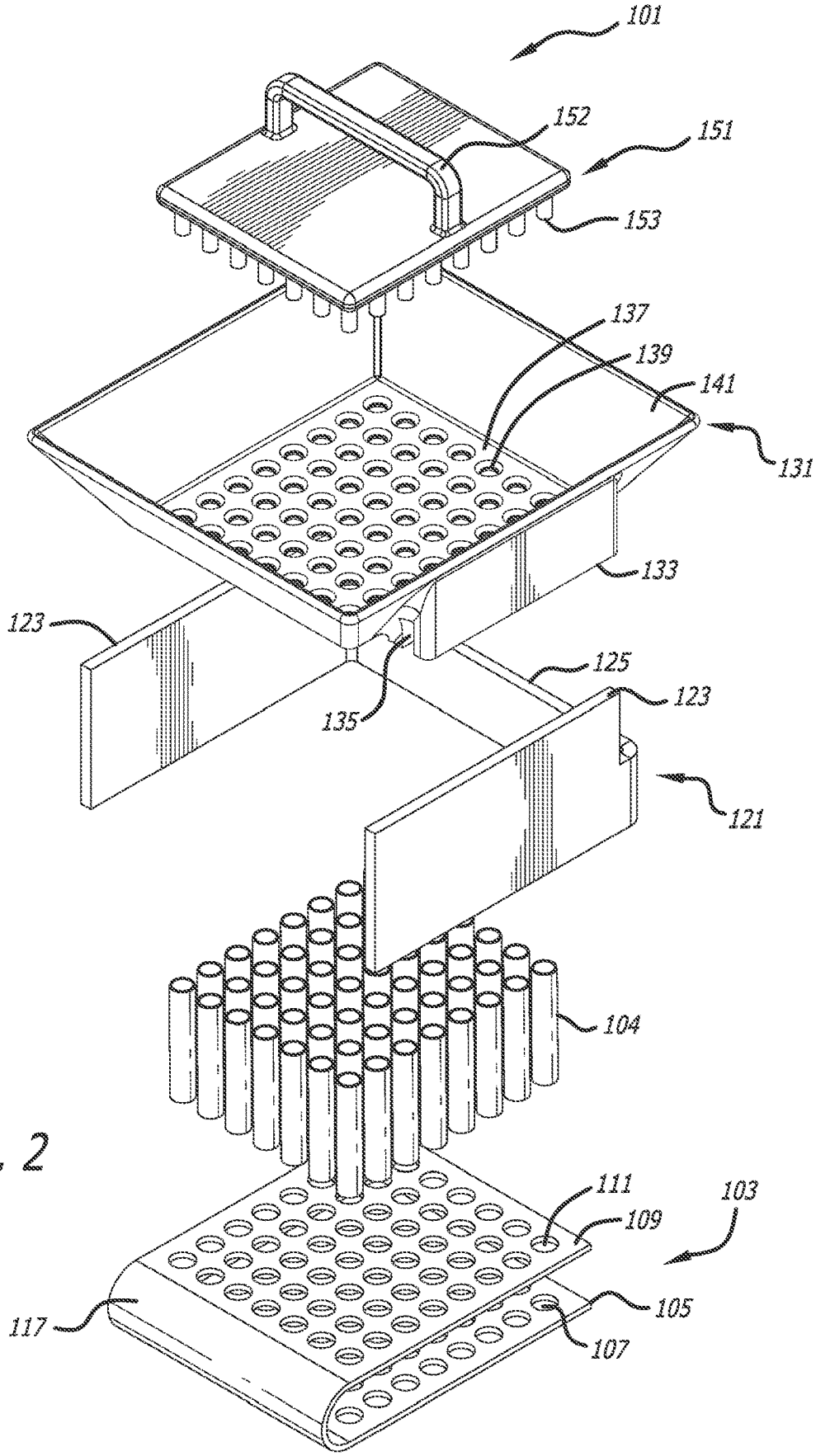
FIG. 2 is an exploded perspective view of the system of FIG. 1
Figure 3:
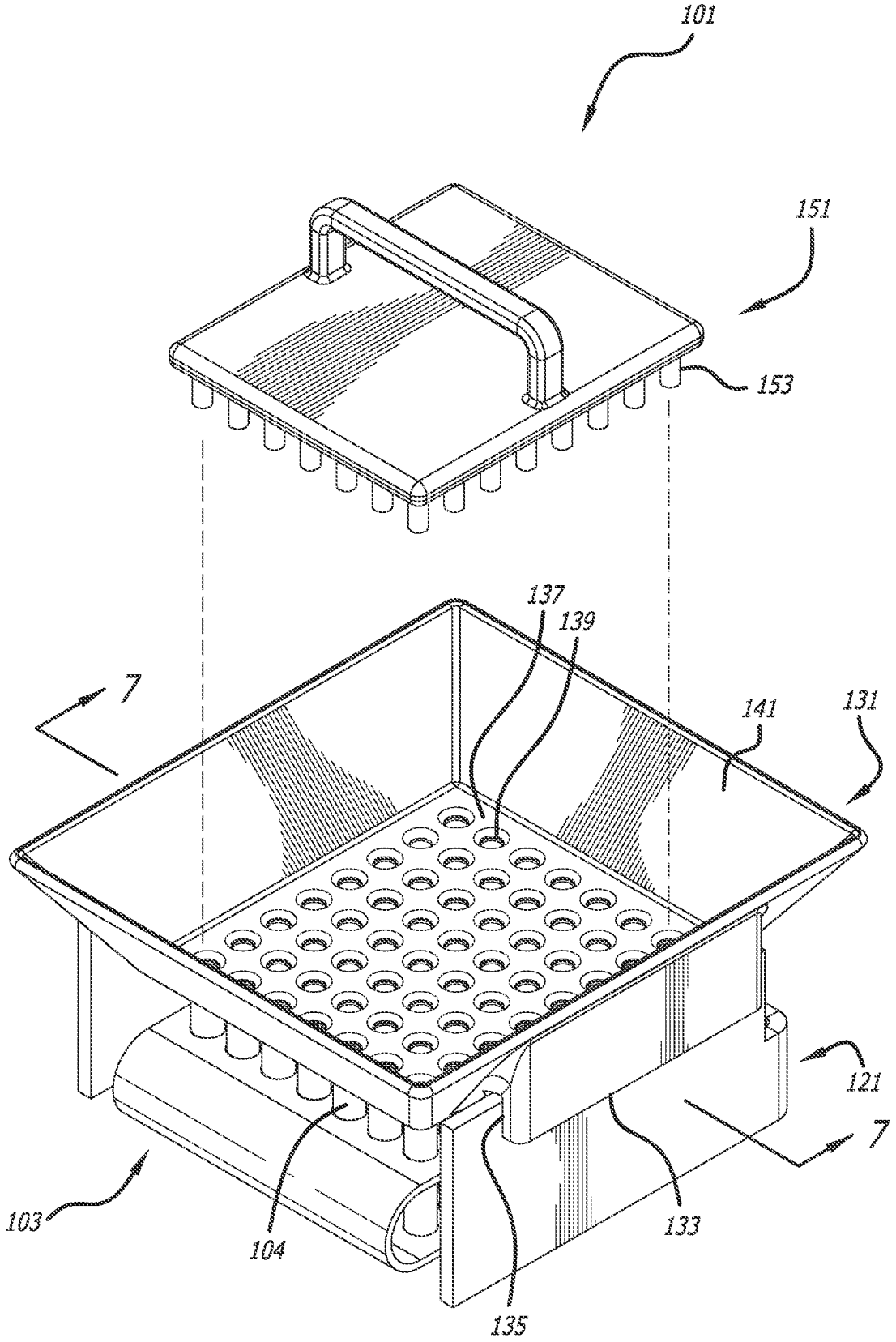
FIG. 3 is a perspective view of the system of FIG. 1, shown with the tamper removed.
Figure 4:
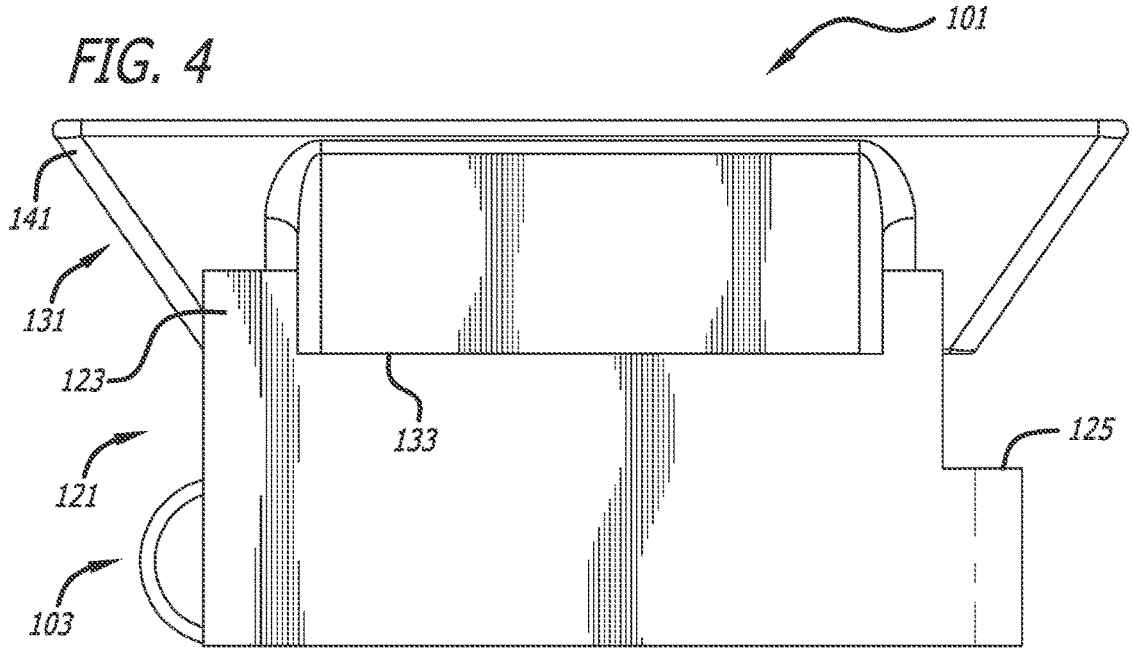
FIG. 4 is a right side view of the system of FIG. 1.
Figure 5:
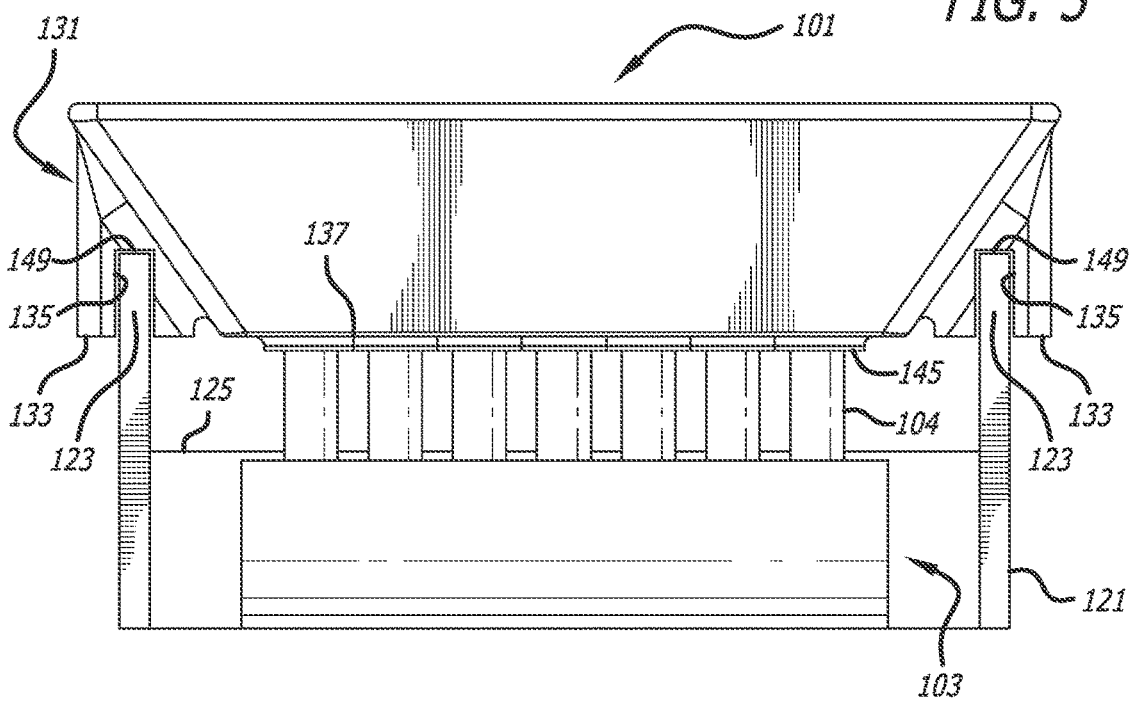
FIG. 5 is a front view of the system of FIG. 1.
Figure 6:
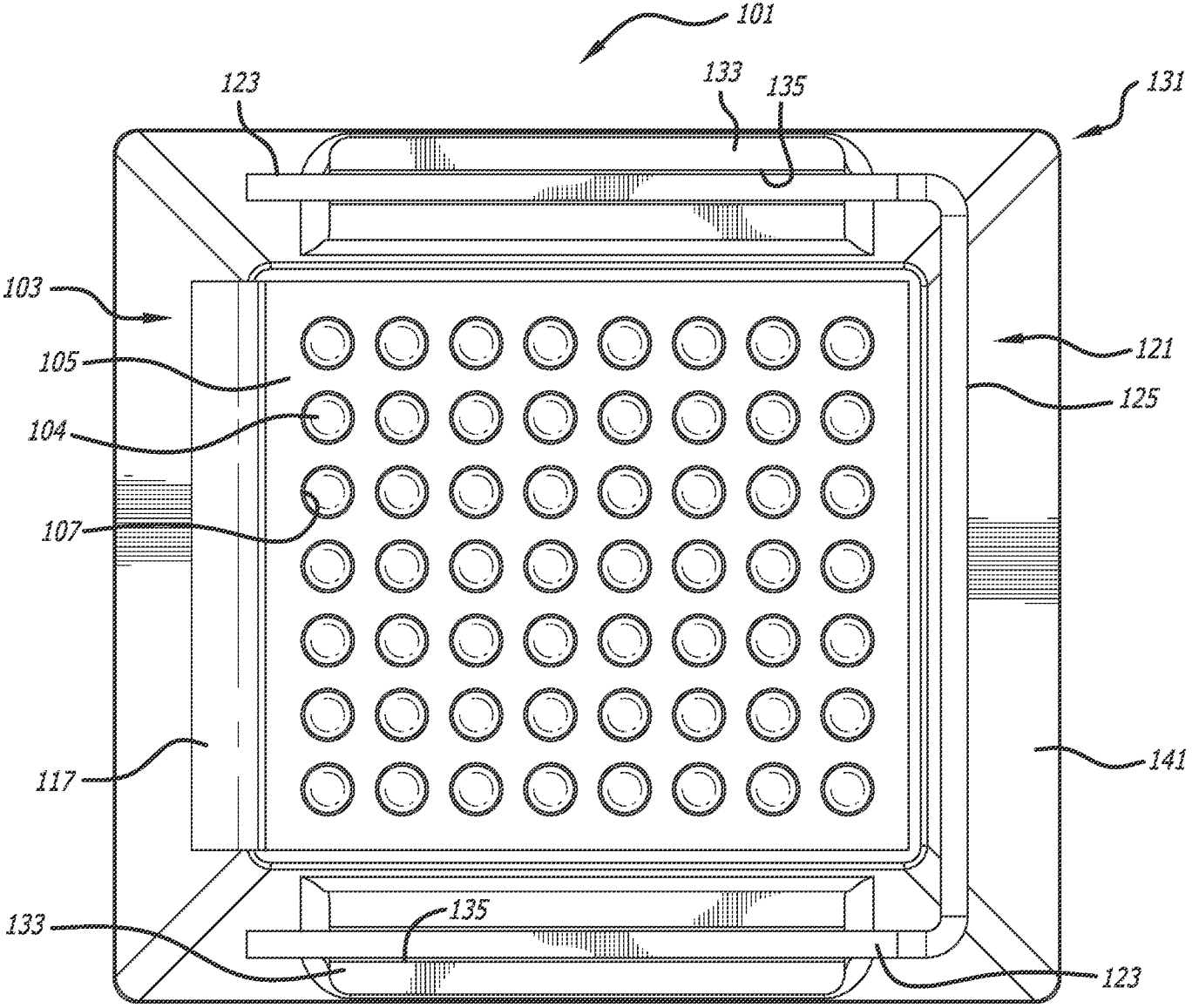
FIG. 6 is a bottom view of the system of FIG. 1.

FIGS. 1-9 depict embodiments of a cartridge processing system, method and apparatus. For example, versions of the cartridge processing system 101 can include a support tray or rack 103 configured to support a plurality of cartridges 104. Embodiments of the rack 103 can include a base 105 with base holes 107 (FIG. 2). In some examples, a support 109 can be cantilevered from the base 105. The support 109 can include support holes 111. Versions of the base holes 107 can be substantially coaxial with respective ones of the support holes 111, as shown. In some embodiments, the cartridges 104 can be configured to be supported in respective pairs of the base and support holes 107, 111 (FIG. 1).

Figure 7:
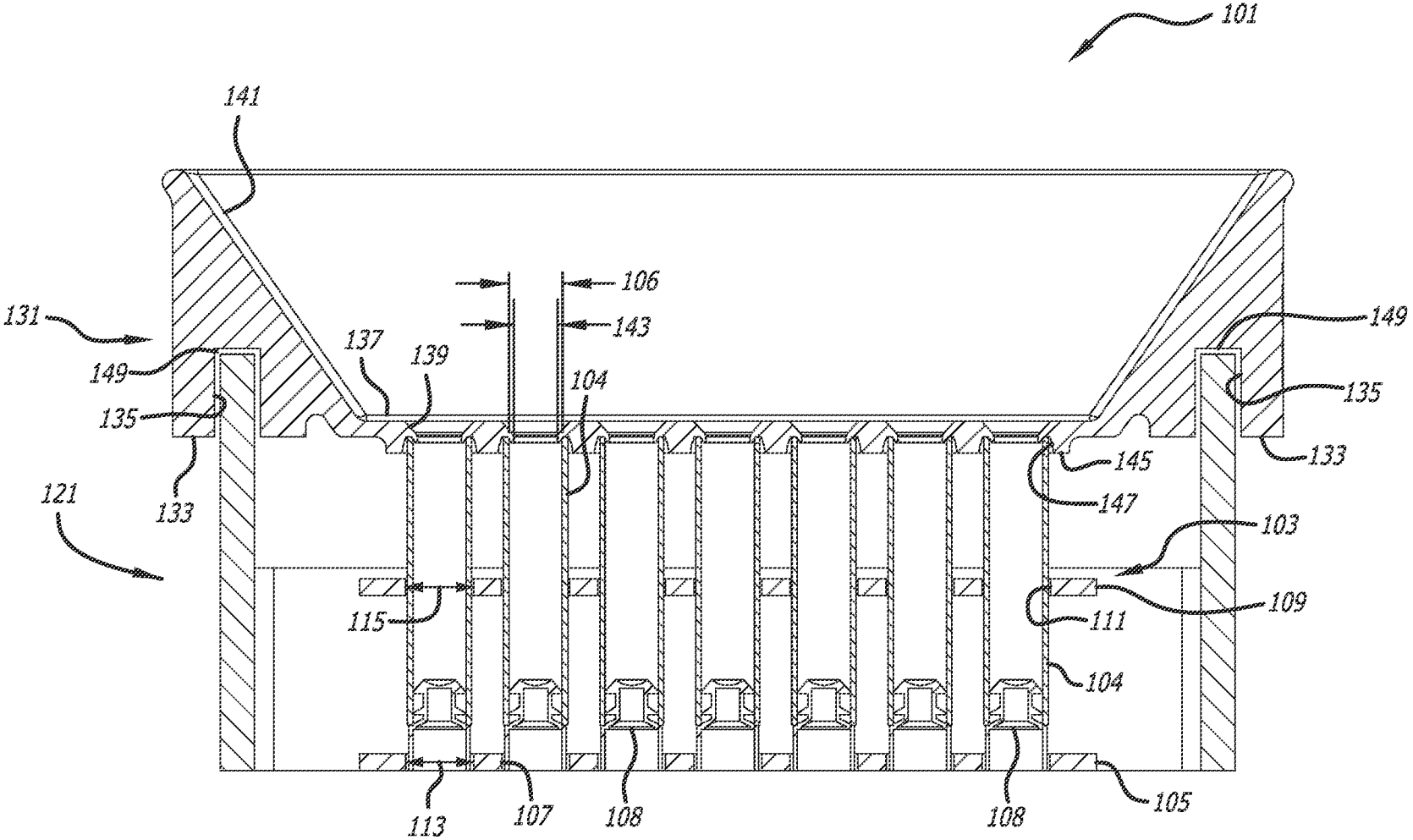
FIG. 7 is a front sectional view of the system of FIG. 1, shown without the tamper.

Examples of the cartridges 104 can be configured to extend through the base holes 107 to an exterior of a bottom of the base 105 (FIG. 7).

In some embodiments of the rack 103 (FIG. 7), the base holes 107 can have a base hole diameter 113 that is less than a support hole diameter 115 of the support holes 111. Examples of both the base 105 and the support 109 can be substantially flat. In one version, the base 105 and the support 109 can be substantially parallel to each other and joined by a curved member 117 (FIGS. 1-3) to form a c-shaped side view profile.

Embodiments of the cartridge processing system 101 also can include a frame or guide 121. The guide 121 can be configured to be located adjacent, such as around, the rack 103 of cartridges 104. In some versions, the guide 121 can include walls 123 extending substantially vertically therefrom. Examples of the walls 123 can be located on opposite lateral sides of the guide 121. In addition, versions of the guide 121 can include an open front, top and bottom (FIG. 2) configured to receive the rack 103, and a closed back 125 extending between the walls 123. In one example, the closed back 125 can have a shorter vertical height than the walls 123.

The cartridge processing system 101 also can include embodiments having a product bowl or tray 131. The tray 131 can be configured to engage the guide 121. For example, the tray 131 can have a lower end 133 with receptacles 135 configured to engage respective ones of the walls 123 of the guide 121. The tray 131 can further include a platform 137 with platform holes 139. During operation, examples of the platform holes 139 can be configured to be substantially coaxial with the base and support holes 107, 111 of the rack 103. Embodiments of the tray 131 can include a funnel 141. The funnel 141 can extend, such as outward and upward, from the platform 137. Versions of the funnel 141 can form a perimeter around the platform 137 and platform holes 139.

Embodiments of the cartridge processing system 101 also can include a tamper 151. Versions of the tamper 151 can include a handle 152, which can be configured to engage the tray 131. In an example, the tamper 151 can include a plurality of extensions 153. The extensions 153 can be configured to extend through respective ones of the platform holes 139 and into respective ones of the cartridges 104. The number of extensions 153 can match the number of platform holes 139, in some embodiments.

As shown in FIG. 7, versions of the platform holes 139 can have a platform hole diameter 143 that is less than a cartridge inner diameter 106 of the cartridges 104. In some embodiments, the platform holes 139 can taper down in diameter from an upper vertical elevation to a lower vertical elevation at the platform hole diameter 143, as illustrated.

In other embodiments, an underside 145 of the tray 131, opposite the platform 137, can include cartridge recesses 147. The cartridge recesses 147 can circumscribe respective ones of the platform holes 139, as shown. In some versions, the cartridge recesses 147 can be configured to receive tops of respective ones of the cartridges 104. For example, the tray 131 can be configured to seat on tops of the cartridges 104. Moreover, the guide 121 can be configured to merely guide alignment of the tray 131 with the guide 121. In one example, the tray 131 can be configured to be vertically spaced apart from (and substantially free of contact with) the guide 121 (see gaps 149 in FIGS. 5 and 7) when the tray 131 is seated on tops of the cartridges 104.

Examples of the cartridges 104 can include a particular size. In one version, each cartridge 104 can have an axial length of about 50 mm, an outer diameter of about 12 mm, and an inner diameter of about 10 mm. Versions of the cartridges 104 can be closed, such as sealed, plugged or capped on one or both ends, with a device such as the plugs 108 shown. In one embodiment, each plug 108 can insert into a cartridge 104 at an axial depth of insertion of about 9 mm. Thus, in one example, a cartridge 104 plugged at both ends with plugs 108 (FIG. 8F) would have about 32 mm of axial length to contain product.

Embodiments of the extensions 153 of the tamper 151 can comprise cylinders. Each extension 153 can have a distal axial length portion 155 (FIG. 8E) configured to substantially match the plug axial depth of insertion of the upper plugs 108 in the cartridges 104 (FIG. 8F), which again can be about 9 mm.

Embodiments of methods of using the cartridge filling system 101 also are included. For example, one version of the method can start as suggested in FIG. 2 with the loading of cartridges 104 in the rack 103 on an underlying support surface. The loaded cartridges 104 can extend above a top of the rack 103, as shown. Bottoms of the loaded cartridges 104 also can be substantially flush with the bottom of the rack 103 and the underlying support surface. In an embodiment, the method can include closing one end of each cartridge 104 with a cap or plug 108 (see FIG. 7). The method can include positioning the frame or guide 121 around the rack 103 of cartridges 104 (see FIGS. 2 and 3), aligning the tray 131 with the frame 121, and seating the tray 131 on tops of the cartridges 104.

Figure 8A:
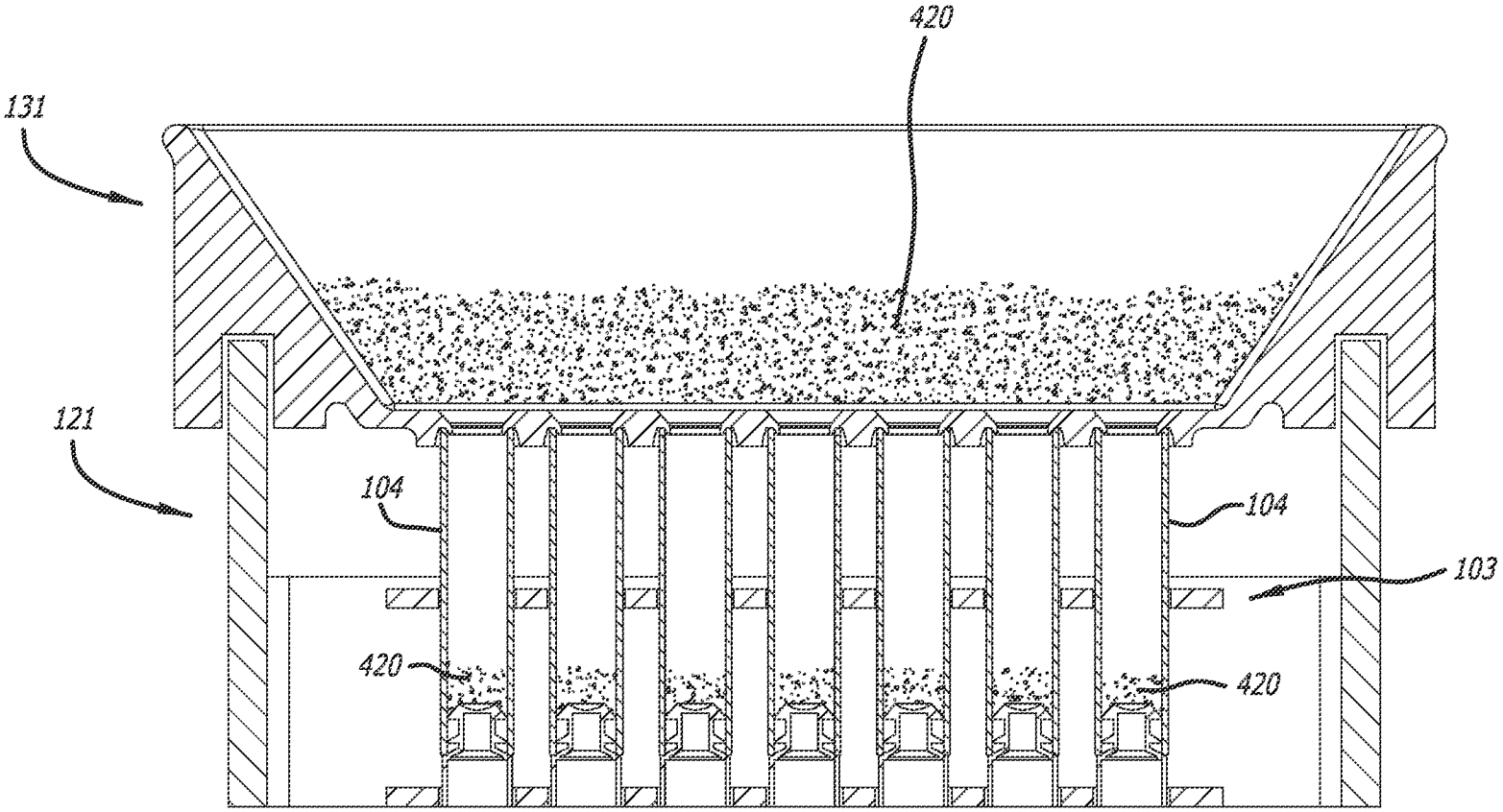
FIGS. 8A-8F depict embodiments of a method of using the system of FIG. 1.
Figure 8B:
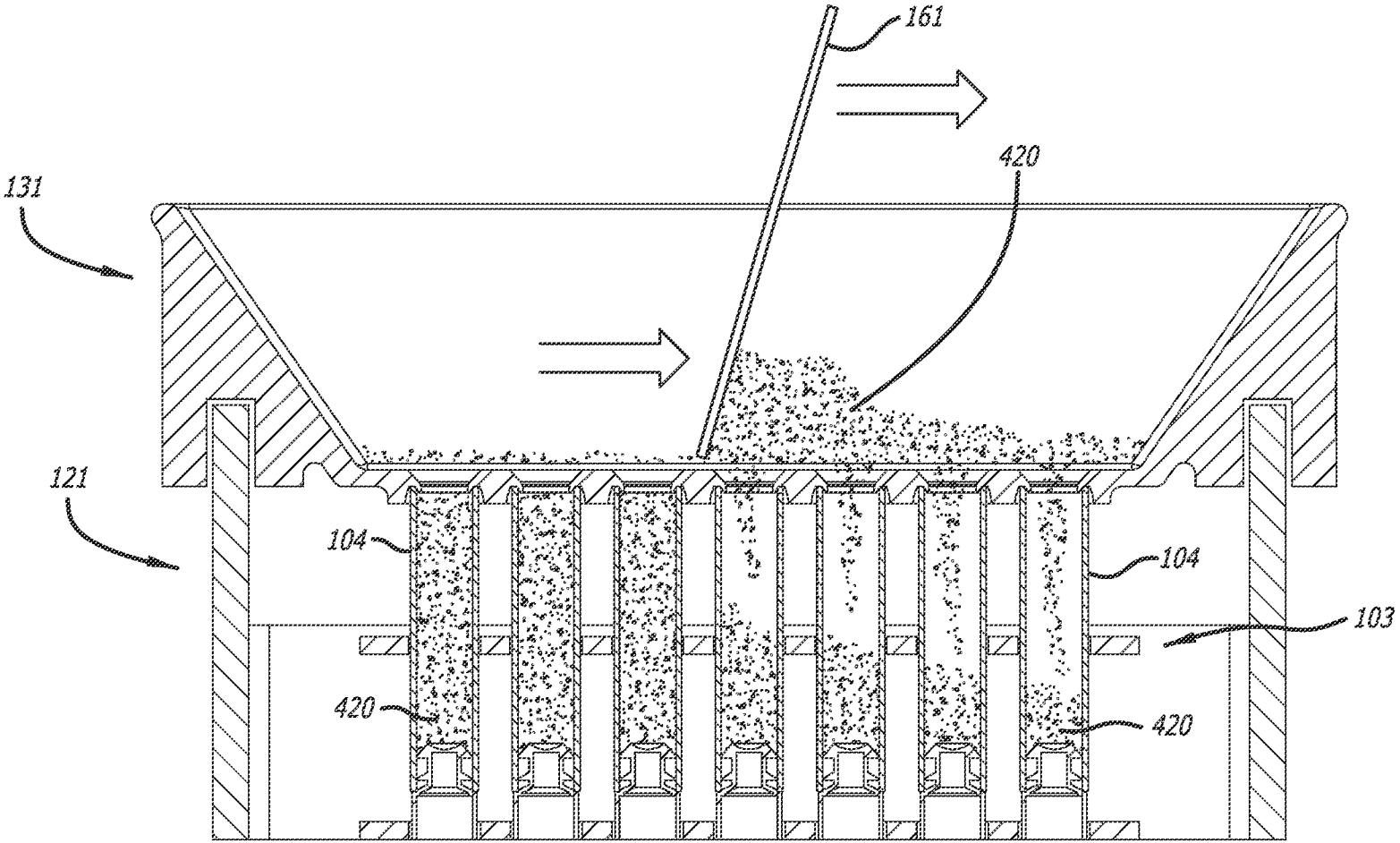
Figure 8C:
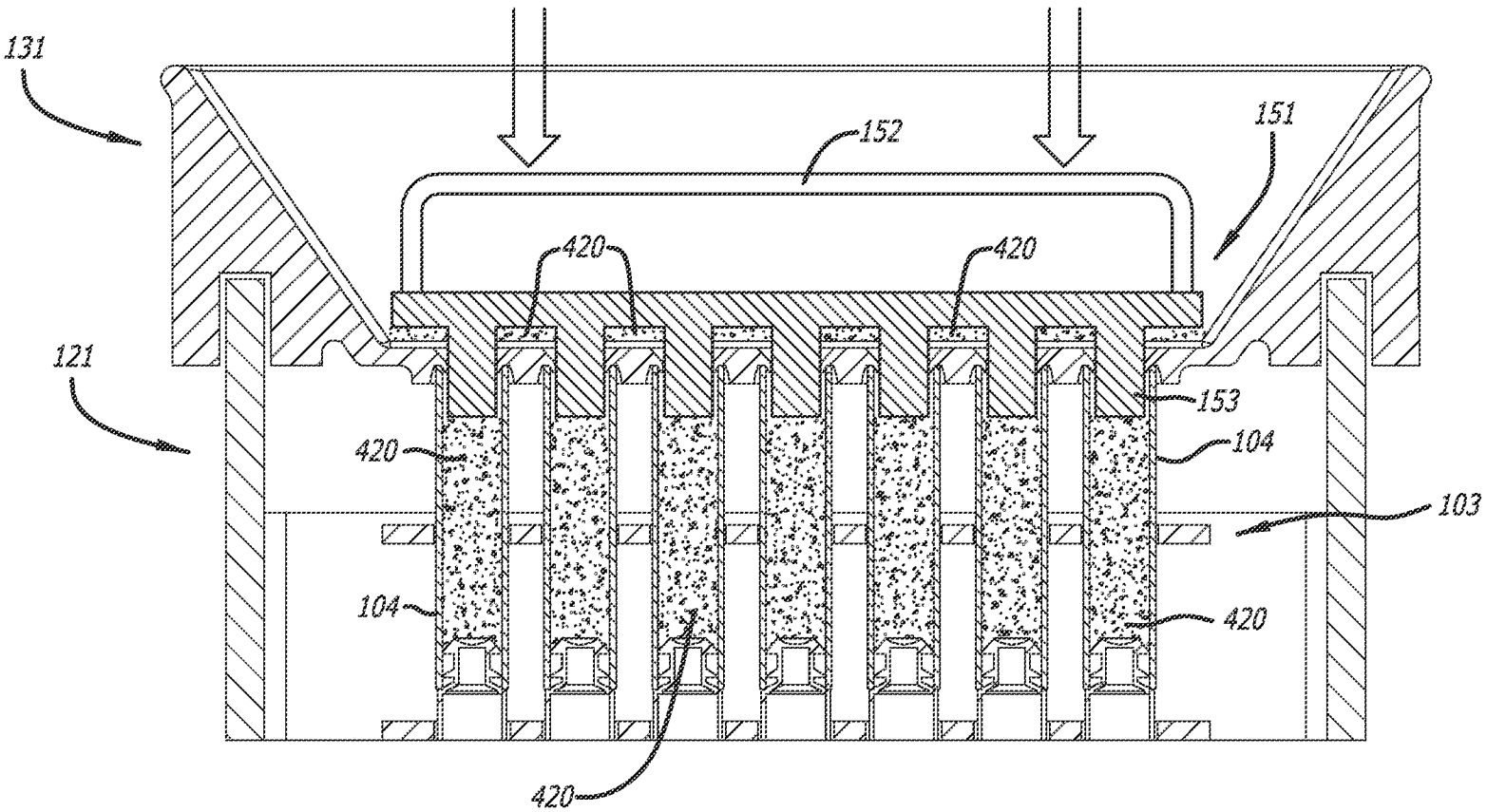
Figure 8D:
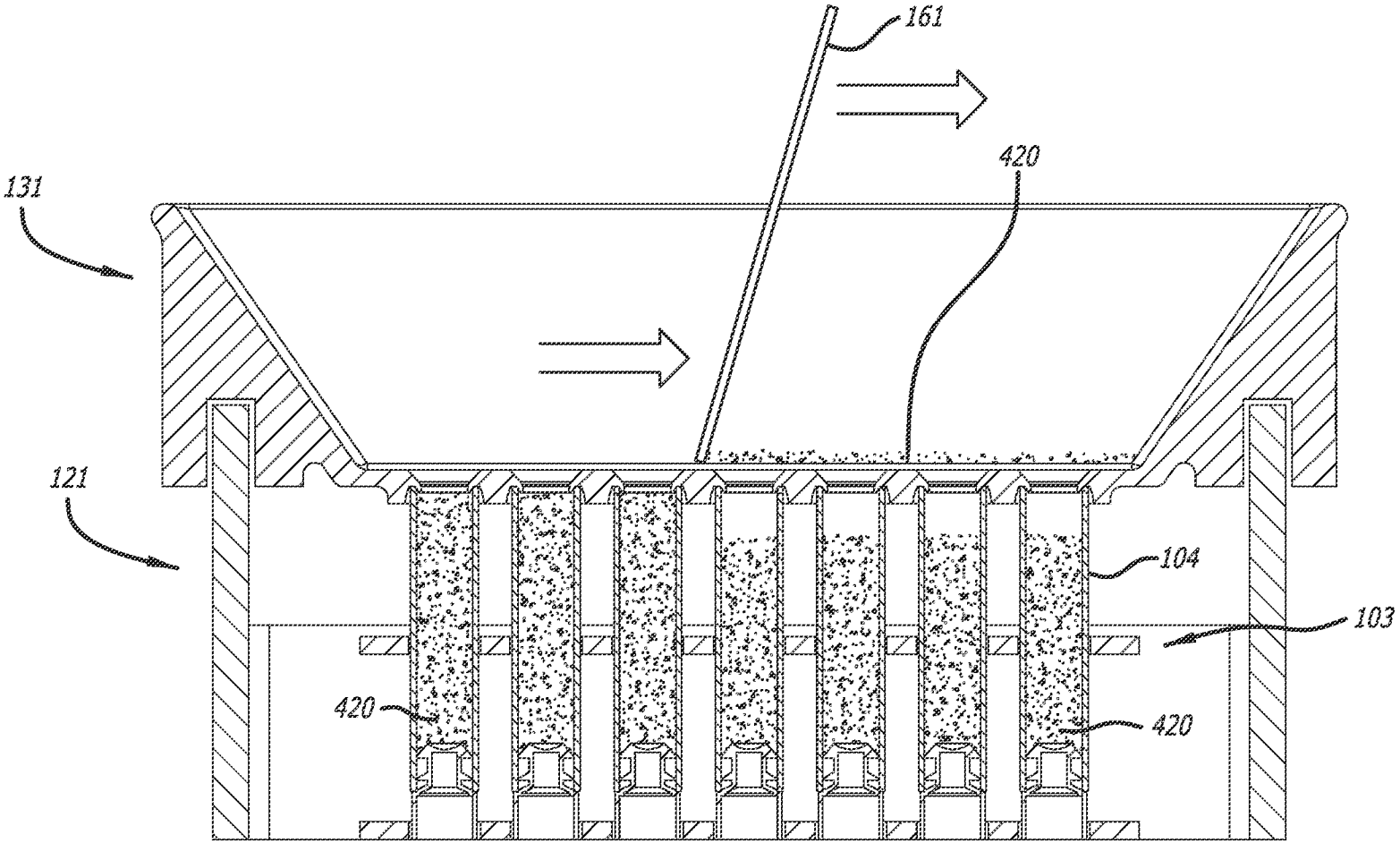
Figure 8E:
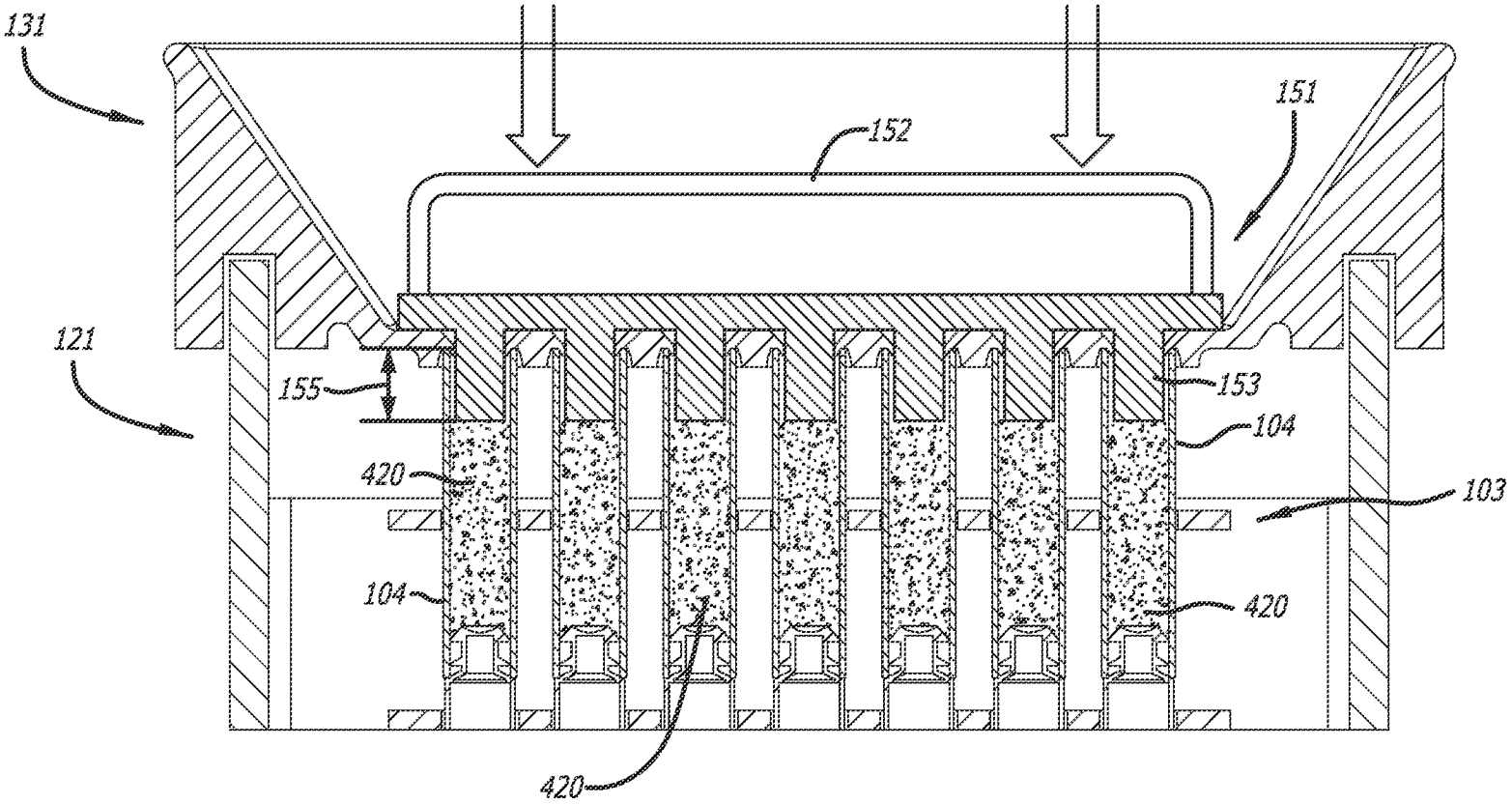
Figure 8F:
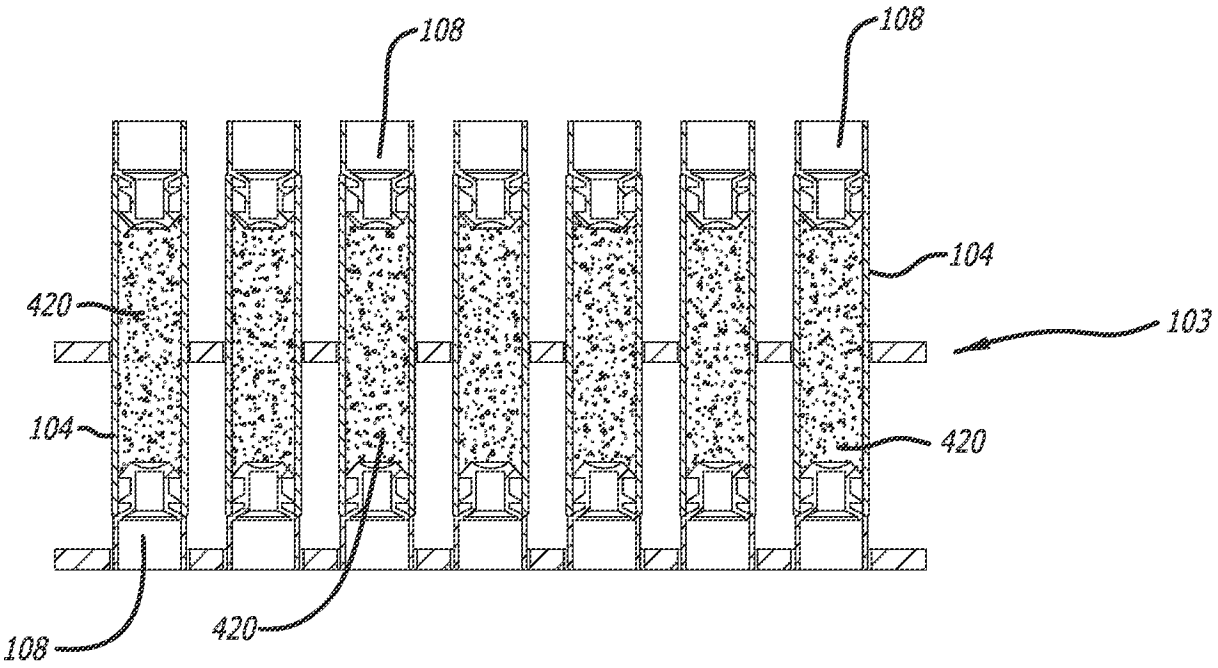

As shown in FIG. 8A, the method can continue by loading the tray 131 with a selected amount of product 420. The product 420 can include, for example, loose particles of material. Thereafter, the method can include manipulating the product 420 in the tray 131 (FIG. 8B) to fall into the cartridges 104. For example, this can be manually such as with a spatula 161 or other device, or by hand. The method can continue by tamping the product 420 with the tamper 151 (FIG. 8C) further down into the cartridges 104. Embodiments of the method can include further manipulating the product 420 (FIG. 8D) remaining in the tray 131 to fall into the cartridges 104. Thereafter, the method can include further tamping of and slightly compressing the product 420 (FIG. 8E) in the cartridges 104. After the cartridges 104 are filled with a desired amount of product 420, the method can include removing the tray 131 from the tops of the cartridges 104, and removing the rack 103 of cartridges 104 from the frame 121. Examples of the method can include closing the cartridges 104 (FIG. 8F) with upper caps or plugs 108 with the product 420 inside the cartridges 104.

Figure 9:
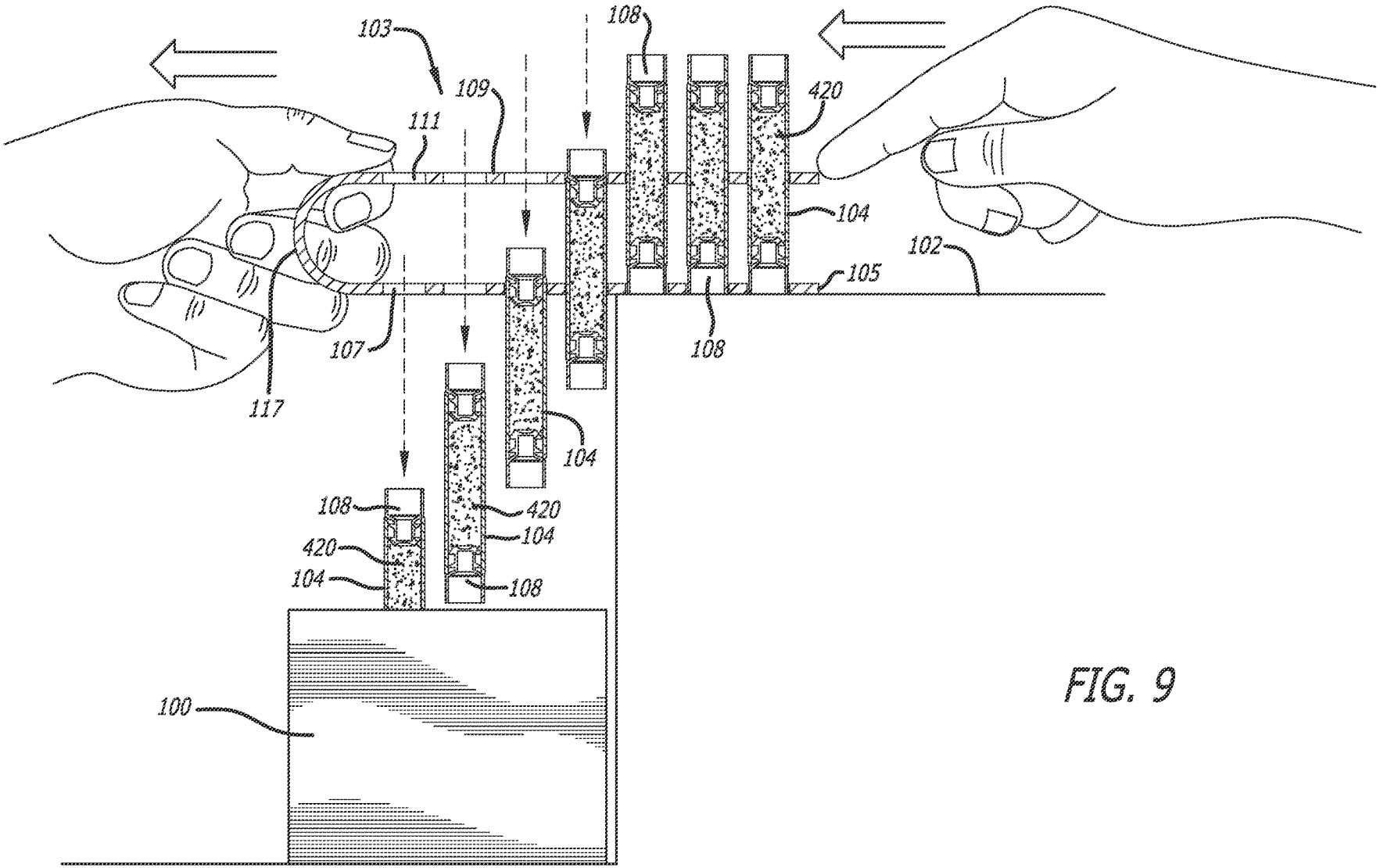
FIG. 9 is a schematic side view depicting an embodiment of the system shown during unloading of the cartridges from the rack.

In FIG. 9, a version of the method can include removing the loaded and sealed cartridges 104 from the rack 103. For example, this can include sliding (e.g., manually sliding, see large arrows) the rack 103 off of the underlying support surface 102, and supporting (e.g., manually supporting) the rack 103 above a container 100. In this method, the cartridges 104 supported by the rack 103 can fall through the bottom of the rack 103 (and through support holes 111 and base holes 107) into the container 100. In some embodiments, the entire process can be performed and completed with manual labor, such that no machines (e.g., a lever, pulley, etc.) or electronics are required.

Figure 10:
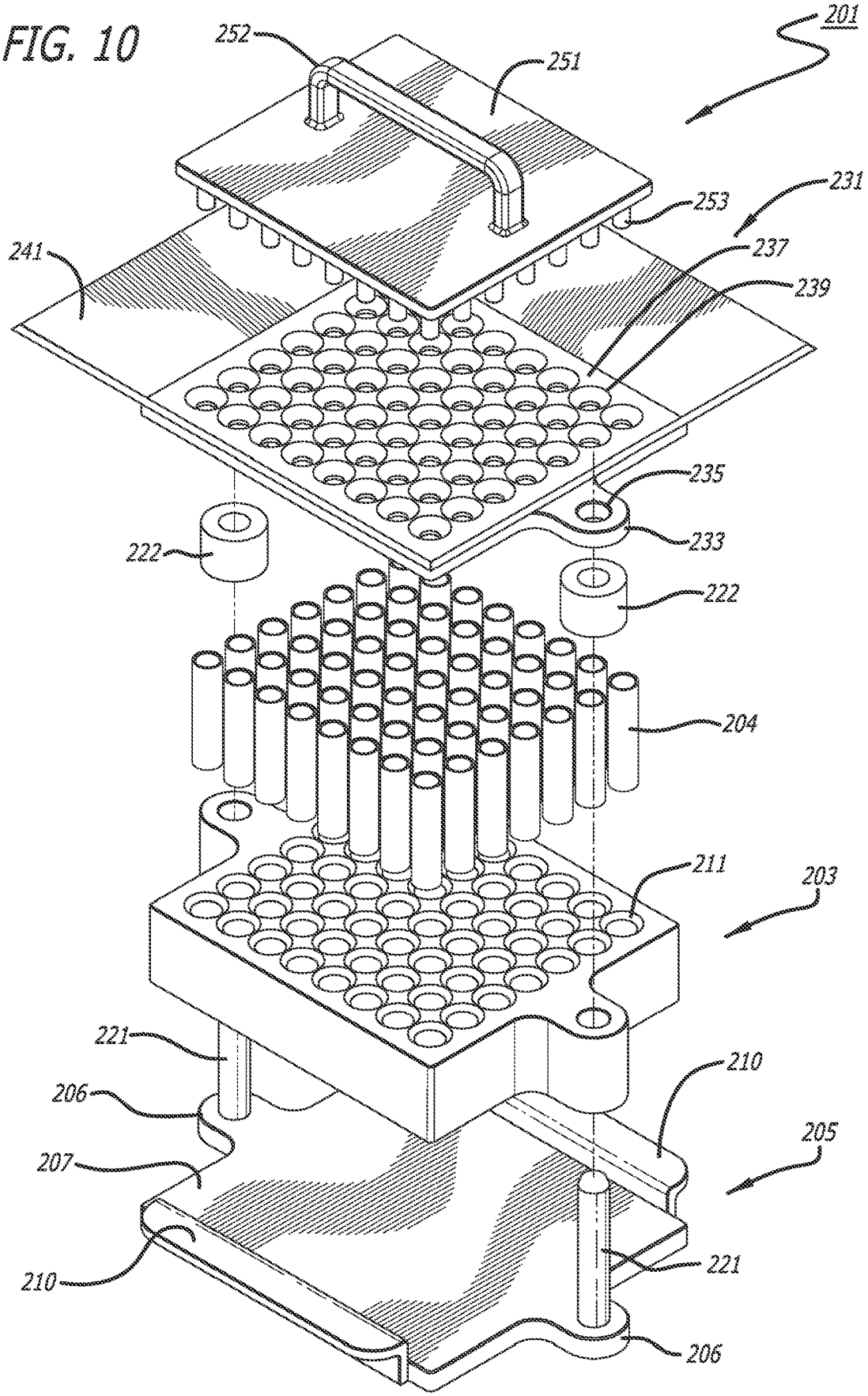
FIG. 10 is a top exploded, isometric view of another embodiment of a cartridge processing system.
Figure 11:
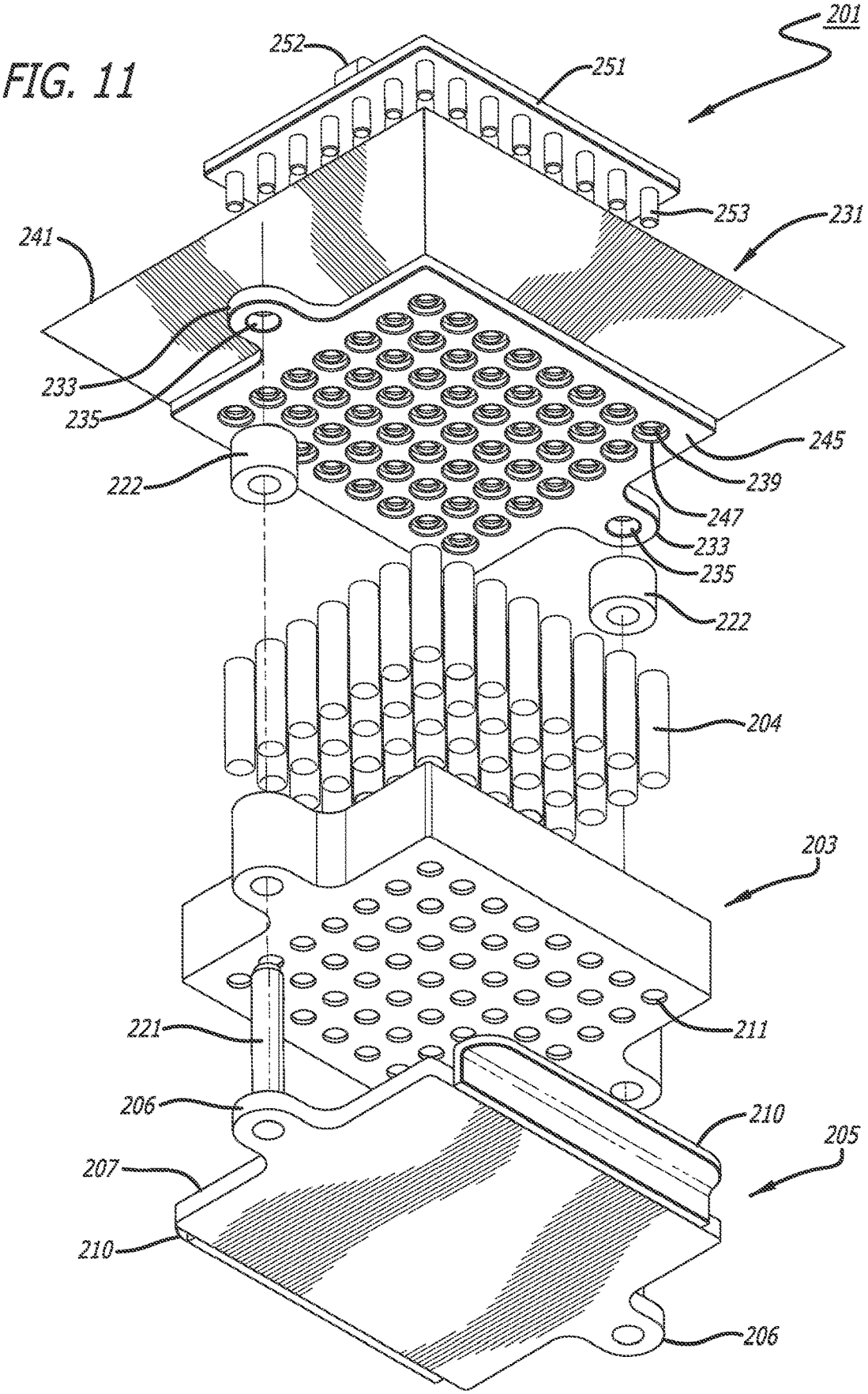
FIG. 11 is bottom exploded, isometric view of the embodiment of FIG. 10.
Figure 12:
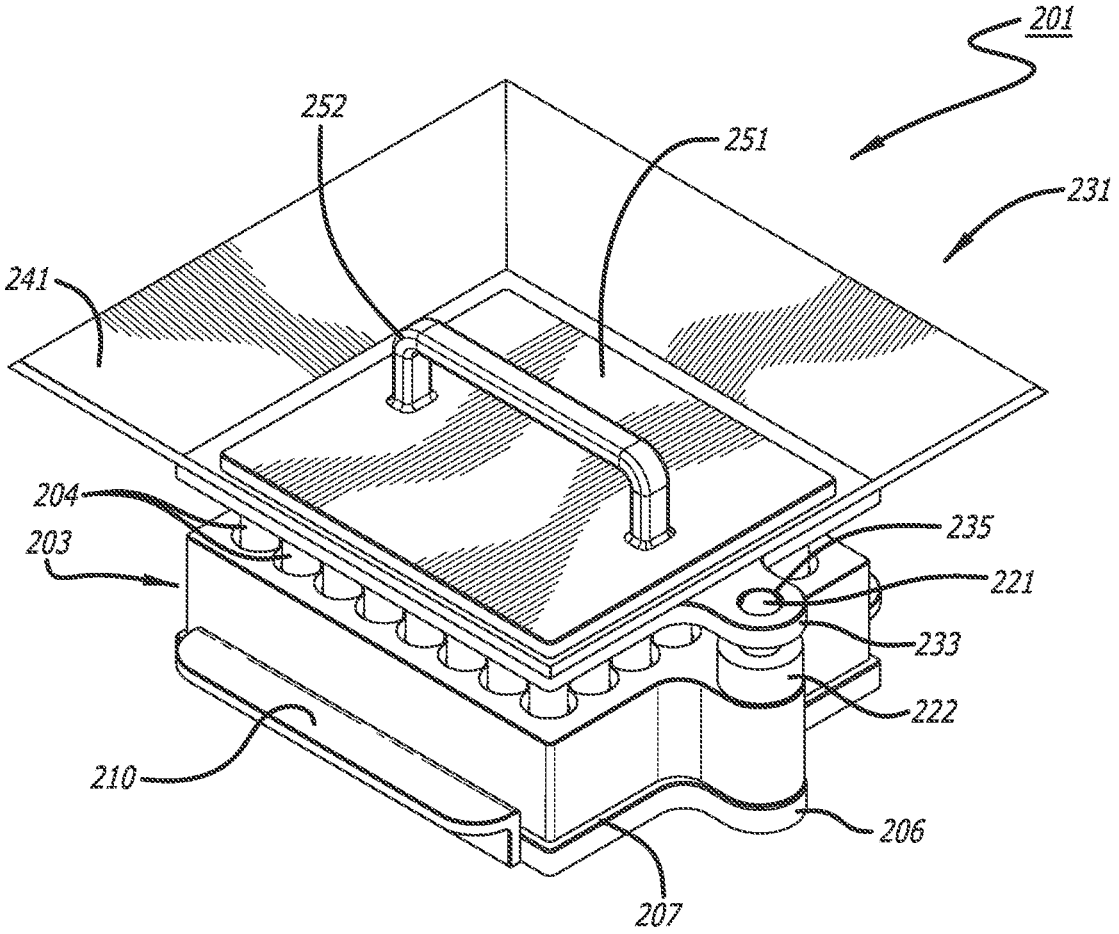
FIG. 12 is a top isometric view of the embodiment of FIG. 10 after assembly.

FIGS. 10-12 depict another embodiment of a cartridge processing system, method and apparatus. For example, versions of the cartridge processing system 201 can include a base 205 and a support rack 203 configured to support a plurality of cartridges 204. Cartridges 204 can be similar or even identical to cartridges 104 described earlier. In some versions, the base 205 and rack 203 can be separate, individual components (as shown). In other versions, the base 205 and rack 203 can be integrally formed as a single, monolithic component (see, e.g., FIGS. 13-15).

Versions of the base 205 can include a generally rectangular, plate-like appearance, such as a plate 207. The plate 207 can include a surface area on which the rack 203 can be supported by the base 205. Examples of the base 205 can include one or more tabs 206 (e.g., two shown) extending laterally from opposite sides of the plate 207. Each tab 206 can include a guide, such as a rod 221. When the base 205 is horizontal, the rods 221 can extend vertically upward therefrom for a selected distance. In the addition, the base 205 can include or more handles 210 (e.g., two shown). The handles 210 can be located opposite from each other along the perimeter of the plate 207, such as the front and back of the base 205. The handles 210 can be configured for manual manipulation of the base 205 (and the rack 203, when it is on the base 205) by a user.

Embodiments of the rack 203 can be generally rectangular in shape, and can have a block-like appearance. The rack 203 can include support holes 211. Versions of the support holes 211 can have a larger inner diameter at a top of the rack 203 (FIG. 10), and a smaller inner diameter at a bottom of the rack 203 (FIG. 11). In some embodiments, the cartridges 204 can be configured to have a consistent outer diameter. The outer diameter of the cartridges 204 can be smaller than the inner diameter of the support holes 211 at the top of the rack 203, and larger than the inner diameter of the support holes 211 at the bottom of the rack. The cartridges 204 can be supported and retained (i.e., by gravity) in the support holes 211 of the rack 203, as shown. Cartridges 204 can be included in a plurality of the racks 203 in an operational filling process. The cartridges 204 and racks 203 can be interchangeable.

The cartridge processing system 201 also can include embodiments having a product bowl or tray 231. The tray 231 can be configured to substantially the same or even identical to tray 131 described herein. Just as tray 131 can engage guide 121, tray 231 can engage the guides or rods 221. Embodiments of the tray 231 can have a lower end 233 with receptacles 235 configured to slidably and releasably engage respective ones of the rods 221. In one example, the rods 221 can extend through the receptacles 235. The tray 231 can further include a platform 237 with platform holes 239. During operation, examples of the platform holes 239 can be configured to be substantially coaxial with the cartridges 204 in the support holes 211 of the rack 203. Embodiments of the tray 231 can include a funnel 241. The funnel 241 can extend, such as outward and upward, from the platform 237. Versions of the funnel 241 can form a perimeter around the platform 237 and platform holes 239.

As previously described for the embodiment of FIG. 7, versions of the platform holes 239 can have a platform hole diameter that is less than a cartridge inner diameter of the cartridges 204. In some embodiments, the platform holes 239 can taper down in diameter from an upper vertical elevation to a lower vertical elevation at the platform hole diameter 243, as described before.

In other embodiments, an underside 245 (FIG. 11) of the tray 231, opposite the platform 237, can include cartridge recesses 247. The cartridge recesses 247 can be similar or even identical to the cartridge recesses 147 described herein for another embodiment. In some versions, the cartridge recesses 247 can be configured to receive tops of respective ones of the cartridges 204. For example, the tray 231 can be configured to seat on tops of the cartridges 204. Moreover, the guides or rods 221 can be configured to merely guide alignment of the tray 231 with the base 205 and tray 203 of cartridges 204.

Examples of the cartridge processing system 201 can include one or more spacers or bushings 222. The bushings 222 can be configured to slidably and releasably mounted to respective ones of the rods 221. The bushings 222 can comprise cylinders with coaxially centered cylindrical holes. The axial dimension of the bushings 222 can be selectively configured. For example, the tray 231 can be configured to be vertically spaced apart from (and substantially free of contact with) the bushings 222 on the rods 221 (e.g., by small gaps) when the tray 231 is seated on tops of the cartridges 204. In some versions, the bushings 222 can have a bushing axial length that is less than a rod axial length of the rods 221. There can be a clearance or gap between the bushings 222 and the tray 231 when the tray 231 is seated on tops of the cartridges 204.

Embodiments of the cartridge processing system 201 also can include a tamper 251, which can be similar or even identical to tamper 151 described earlier, and can function in the same way. Versions of the tamper 251 can include a handle 252 and extensions 253.

Embodiments of methods of using the cartridge filling system 201 also are included. The methods can be similar and use similar techniques as described for other embodiments herein. For example, one version of the method can start with the loading of cartridges 204 in the rack 203. One end of each cartridge 204 can be closed with a cap or plug. The method can include positioning the rack 203 on the base 205, aligning the receptacles 235 of the tray 231 with the rods 221, and seating the tray 231 on tops of the cartridges 204.

Versions of the method can continue by loading the tray 231 with a selected amount of product. The product can include, for example, loose particles of material. Thereafter, the method can include manipulating the product in the tray 231 to fall into the cartridges 204. The method can continue by tamping the product with the tamper 251 further down into the cartridges 204. Embodiments of the method can include further manipulating the product remaining in the tray 231 to fall into the cartridges 204. Thereafter, the method can include further tamping of and slightly compressing the product in the cartridges 204. After the cartridges 204 are filled with a desired amount of product, the method can include removing the tray 231 from the tops of the cartridges 204, and removing the rack 203 of cartridges 204 from the base 205. Examples of the method can include closing the cartridges 204 with upper caps or plugs with the product inside the cartridges 204. A version of the method can include removing the loaded and sealed cartridges 104 from the rack 103. Another rack 203 of cartridges 204 without product can then be placed on the base 205 such that the method can repeat.

Figure 13:
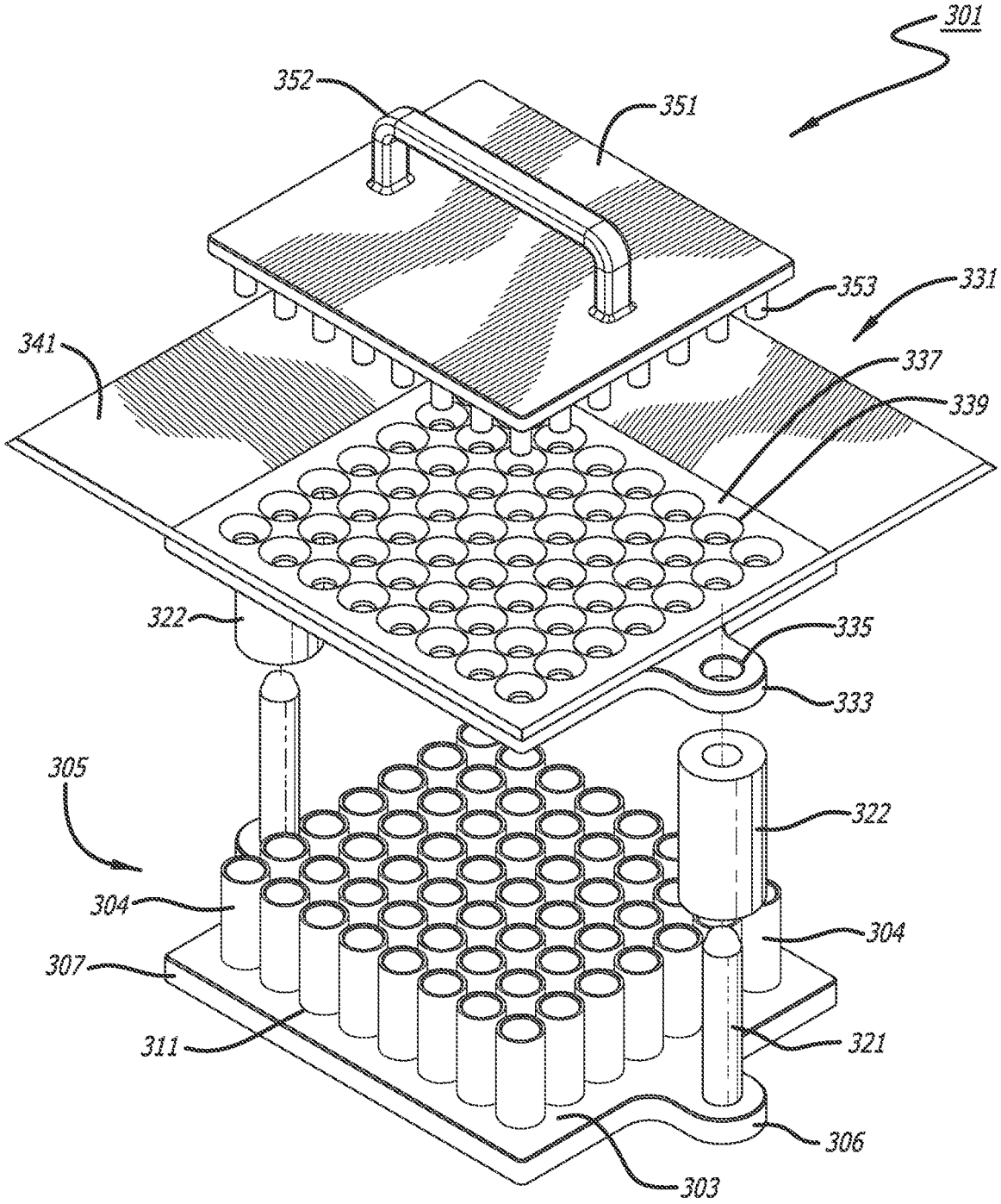
FIG. 13 is a top exploded, isometric view of an alternate embodiment of a cartridge processing system.
Figure 14:
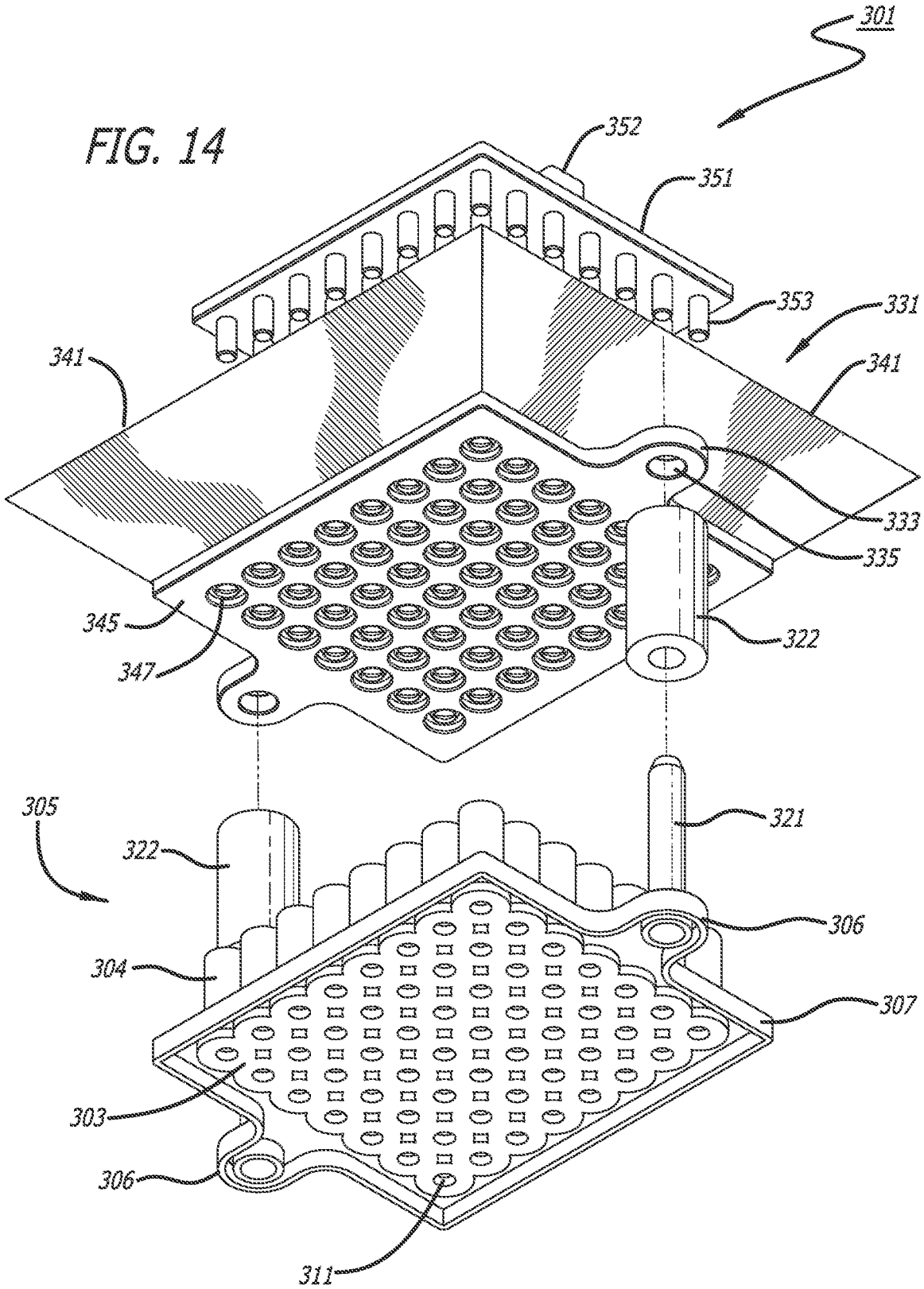
FIG. 14 is bottom exploded, isometric view of the embodiment of FIG. 13.
Figure 15:
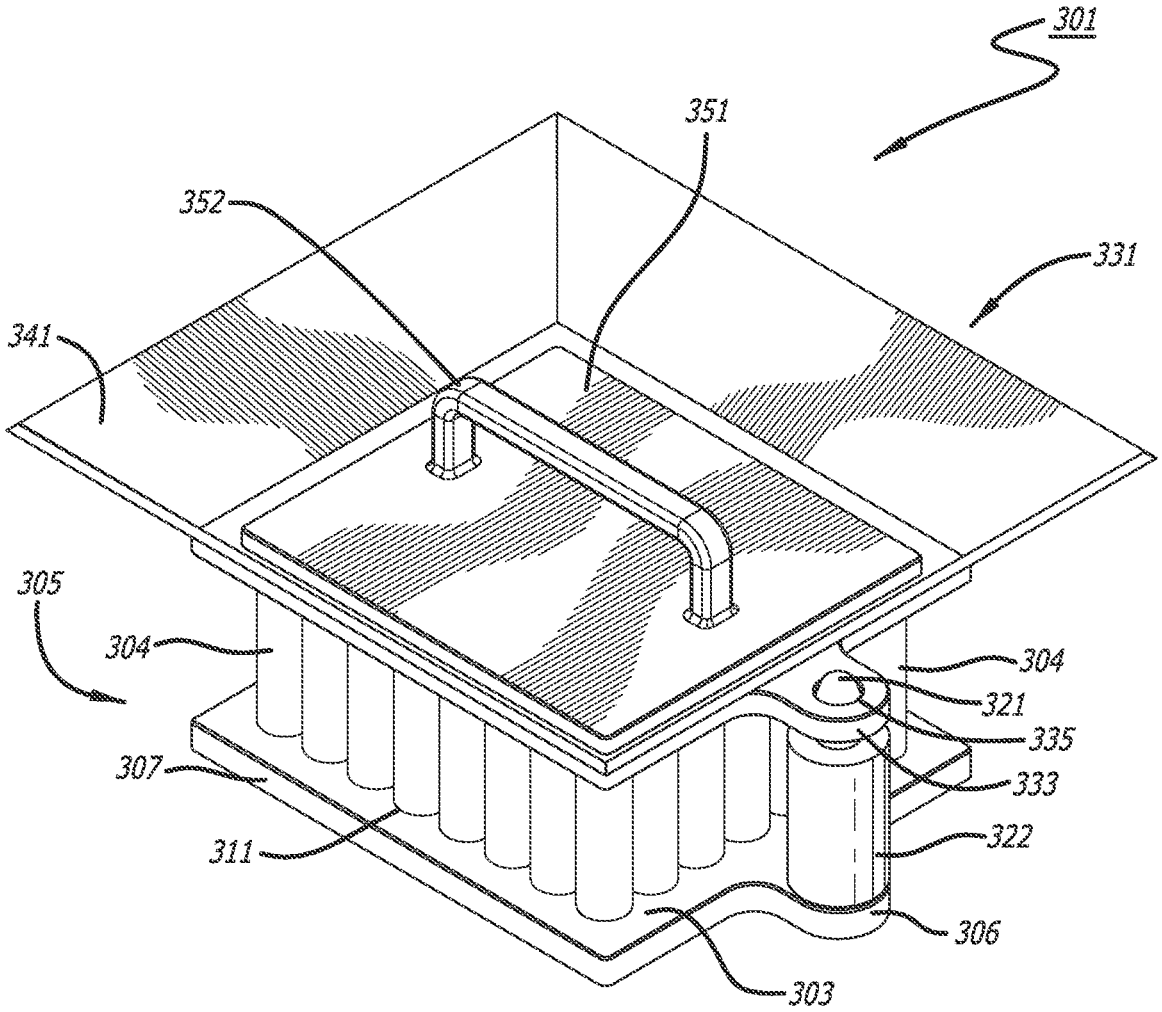
FIG. 15 is a top isometric view of the embodiment of FIG. 13 after assembly.

FIGS. 13-15 depict another embodiment of a cartridge processing system, method and apparatus. For example, versions of the cartridge processing system 301 can be similar and, in some features and components, identical to the embodiment of system 201, including a base 305, support rack 303 and cartridges 304. In this version, the base 205 and rack 203 can be integrally formed as a single, monolithic component. Cartridges 304 can be included in a plurality of the racks 303 in an operational product filling process. The cartridges 304 and racks 303 can be interchangeable.

Versions of the base 305 can include a plate 307 with tabs 306 and guides, such as rods 321 on opposite sides. Embodiments also can include a tray 331 with receptacles 335 that can engage rods 321. The tray 331 can further include a platform 337 with platform holes 339, a funnel 341 and a tamper 351, as described for the other embodiments.

Examples of the cartridge processing system 301 can include spacers or bushings 322. The bushings 322 can be configured to slidably and releasably mounted to respective ones of the rods 321. The bushings 322 can comprise cylinders with coaxially centered cylindrical holes. The axial dimension of the bushings 322 can be selectively configured. For example, the tray 331 can be vertically spaced apart from the bushings 322 (by small gaps) while engaged with the rods 321 when the tray 331 is seated on tops of the cartridges 304. In some versions, the bushings 322 can have a bushing axial length that is longer than that of bushings 222, since tray 303 is formed in base 305.

Embodiments of methods of using the cartridge filling system 301 also are included. The methods can be similar and use similar techniques as described for other embodiments herein. A plurality of racks 303 (and bases 305) of cartridges 304 without product can be can be used to repeat the method.

Other embodiments may include one or more of the following features.

1. A cartridge processing system, comprising:

a base configured to support cartridges on an underlying support surface, the base having a rack with support holes configured to support respective ones of the cartridges; and a tray comprising a tray bottom configured to be removably placed on tops of the cartridges, a platform with platform holes configured to be substantially coaxially aligned with respective ones of the support holes, and the tray has a funnel extending from the platform, wherein the funnel forms a perimeter around the platform holes, such that the platform holes are configured to be conduits for product to be placed in the cartridges.

2. The cartridge processing system of claim 1, wherein the base and the rack are integrally formed as a single, monolithic structure.

3. The cartridge processing system of claim 1, wherein the base and the rack are separate components, such that the rack can be placed on and removed from the base.

4. The cartridge processing system of claim 1, wherein the rack comprises a plurality of racks, each of which can be selectively used with the base.

5. The cartridge processing system of claim 1, wherein the support holes comprise a support hole inner diameter that is greater than a cartridge outer diameter of the cartridges.

6. The cartridge processing system of claim 1, wherein both the base and the platform are substantially flat.

7. The cartridge processing system of claim 1, further comprising a guide configured to be located adjacent the rack.

8. The cartridge processing system of claim 7, wherein a tray portion of the tray comprises a receptacle configured to engage the guide.

9. The cartridge processing system of claim 7, wherein guide portions of the guide are configured to be located on opposite lateral sides of the rack.

10. The cartridge processing system of claim 7, wherein the guide is configured to guide alignment of the tray with the rack, such that the tray is configured to be vertically spaced apart from the rack when the tray is seated on tops of the cartridges.

11. The cartridge processing system of claim 1, wherein the platform of the tray is opposite the tray bottom.

12. The cartridge processing system of claim 11, wherein the tray bottom comprises cartridge recesses that circumscribe respective ones of the platform holes, and the cartridge recesses are configured to receive tops of respective ones of the cartridges.

13. The cartridge processing system of claim 1, wherein the platform holes have a platform hole diameter that is less than a cartridge inner diameter of the cartridges.

14. The cartridge processing system of claim 13, wherein the platform holes taper down in diameter from the platform to the tray bottom.

15. The cartridge processing system of claim 1, wherein the cartridges are configured to comprise upper plugs having a plug axial depth of insertion.

16. The cartridge processing system of claim 15, further comprising a tamper configured to engage the tray, the tamper having a plurality of extensions configured to extend through respective ones of the platform holes and into respective ones of the cartridges.

17. The cartridge processing system of claim 16, wherein the plurality of extensions of the tamper comprise cylinders, and each cylinder has a distal axial length portion configured to substantially match the plug axial depth of insertion of the upper plugs in the cartridges.

18. A method of processing cartridges, the method comprising:

(a) loading cartridges in a rack on an underlying support surface;

(b) placing a tray on tops of the cartridges;

(c) loading the tray with a selected amount of product;

(d) manipulating the product in the tray to fall into the cartridges;

(e) tamping the product in the cartridges further down into the cartridges;

(f) further manipulating product remaining in the tray to fall into the cartridges;

(g) further tamping the product in the cartridges further down into in the cartridges;

(h) removing the tray from the tops of the cartridges;

(i) closing tops of the cartridges; and then (j) removing the rack from the underlying support surface.

19. The method claim 18, wherein step (b) comprises aligning the tray with the rack, directly contacting an underside of the tray with the tops of the cartridges, and maintaining a gap between the tray and guides associated with the rack.

20. The cartridge processing system of claim 1, wherein the base comprises handles on opposite sides of the base, wherein the handles are configured for manual manipulation of the base by a user.

21. The cartridge processing system of claim 1, wherein the base comprises a guide extending from the base.

22. The cartridge processing system of claim 21, wherein the guide comprises guides on opposite sides of the rack.

23. The cartridge processing system of claim 22, wherein the guides comprise rods extending from the base, wherein the rods are configured to engage receptacles on the tray.

24. The cartridge processing system of claim 23, wherein the rods are configured to guide alignment of the tray with the rack, such that the tray is configured to be vertically spaced apart from the rack when the tray is seated on tops of the cartridges.

25. The cartridge processing system of claim 24, wherein the rods are configured to extend through rack receptacles of the rack.

26. The cartridge processing system of claim 24, further comprising bushings configured to be removably mounted to respective ones of the rods.

27. The cartridge processing system of claim 26, wherein the bushings are configured to be located directly between the rack and the tray.

28. The cartridge processing system of claim 26, wherein the bushings are configured to be located directly between the base and the tray.

29. The cartridge processing system of claim 26, wherein the bushings have a bushing axial length that is less than a rod axial length of the rods, such that there is a clearance between the bushings and the tray when the tray is seated on tops of the cartridges.

30. A cartridge processing system, comprising:

a rack configured to support cartridges on an underlying support surface, the rack having a base with base holes, a support extending from the base, support holes in the support, and the base holes are substantially coaxial with respective ones of the support holes, such that the cartridges are configured to extend through the support holes above the rack, and through the base holes into contact with the underlying support surface; and a tray comprising a platform with platform holes configured to be substantially coaxially aligned with the base and support holes of the rack, the tray having a funnel extending from the platform, wherein the funnel forms a perimeter around the platform holes, such that the platform holes are configured to be conduits for product to be placed in the cartridges.

31. The cartridge processing system of claim 30, wherein the support of the rack is cantilevered from the base.

32. The cartridge processing system of claim 30, wherein the base holes have a base hole diameter that is less than a support hole diameter of the support holes.

33. The cartridge processing system of claim 32, wherein the base hole diameter is greater than a cartridge outer diameter of the cartridges.

34. The cartridge processing system of claim 30, wherein both the base and the platform are substantially flat.

35. The cartridge processing system of claim 34, wherein the base and platform are substantially parallel to each other and joined by a curved member to form a c-shaped side view profile.

36. The cartridge processing system of claim 30, further comprising a guide configured to be located adjacent the rack, the guide having walls extending substantially vertically therefrom.

37. The cartridge processing system of claim 36, wherein a lower end of the tray comprises receptacles configured to engage respective ones of the walls of the guide.

38. The cartridge processing system of claim 36, wherein the walls are located on opposite lateral sides of the guide, the guide has an open front and bottom configured to receive the rack, an open top and a closed back extending between the walls.

39. The cartridge processing system of claim 38, wherein the closed back has a shorter vertical height than the walls.

40. The cartridge processing system of claim 37, wherein the platform of the tray is opposite the lower end.

41. The cartridge processing system of claim 40, wherein the lower end comprises cartridge recesses that circumscribe respective ones of the platform holes, and the cartridge recesses are configured to receive tops of respective ones of the cartridges.

42. The cartridge processing system of claim 36, wherein the tray is configured to seat on tops of the cartridges, the guide is configured to guide alignment of the tray with the guide, such that the tray is configured to be vertically spaced apart from the guide when the tray is seated on tops of the cartridges.

43. The cartridge processing system of claim 30, wherein the platform holes have a platform hole diameter that is less than a cartridge inner diameter of the cartridges.

44. The cartridge processing system of claim 43, wherein the platform holes taper down in diameter from an upper vertical elevation to a lower vertical elevation at the cartridge inner diameter.

45. The cartridge processing system of claim 30, wherein the cartridges comprise upper plugs having a plug axial depth of insertion.

46. The cartridge processing system of claim 45, further comprising a tamper configured to engage the tray, the tamper having a plurality of extensions configured to extend through respective ones of the platform holes and into respective ones of the cartridges.

47. The cartridge processing system of claim 46, wherein the plurality of extensions of the tamper comprise cylinders, and each cylinder has a distal axial length portion configured to substantially match the plug axial depth of insertion of the upper plugs in the cartridges.

48. A method of processing cartridges, the method comprising:

(a) loading cartridges in a rack on an underlying support surface;

(b) loading a tray with a selected amount of product;

(c) manipulating the product in the tray to fall into the cartridges;

(d) tamping the product in the cartridges further down into the cartridges;

(e) further manipulating product remaining in the tray to fall into the cartridges;

(f) further tamping the product in the cartridges further down into in the cartridges;

(g) removing the tray from the tops of the cartridges;

(h) closing tops of the cartridges; and then (i) sliding the rack off of the underlying support surface and supporting the rack above a container such that the cartridges fall through a bottom of the rack into the container.

49. The method claim 48, wherein after step (a) and before step (b) the method further comprises positioning a frame around the rack of cartridges.

50. The method claim 49, further comprising aligning the tray with the frame and seating the tray on tops of the cartridges; and wherein step (g) comprises removing the tray from the tops of the cartridges, and the rack of cartridges from the frame.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The term "discreet," as well as derivatives thereof, references to the amount of skin exposed by a user of the garment, rather than the type of style of the garment. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one skilled in the art would know to be a reasonable tolerance for the parts mentioned.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method of processing cartridges, the method comprising:

(a) loading cartridges in a rack, wherein the cartridges each include a cartridge top and an upper cartridge opening defined by the cartridge top, wherein the cartridges each include an upper rim having a radial thickness and defining a radially inner edge of the rim and a radially outer edge of the rim, wherein the upper rim further defines an uppermost surface with an uppermost edge of the cartridge tops disposed radially outward relative to the inner edge and radially inward relative to the radially outer edge;

(b) positioning a tray above the rack, wherein the tray includes a platform defining a plurality of platform holes extending fully through the platform, wherein each of the platform holes has an upper platform opening and a lower platform opening, wherein a maximum diameter of the lower platform opening is smaller than a maximum diameter of the upper cartridge opening, wherein positioning the tray comprises placing the tray directly on the cartridge tops such that the tray directly contacts the uppermost edge of the cartridge tops, wherein positioning the tray comprises at least partially inserting the lower platform opening through the upper cartridge opening to contact the radially inner edge of the rim, and wherein the tray includes a plurality of cartridge recesses that circumscribe respective ones of the platform holes such that the cartridge recesses receive the cartridge top of the cartridges;

(c) loading the tray with a selected amount of product;

(d) manipulating the product in the tray to fall through the platform holes in the tray into the cartridges;

(e) tamping the product in the cartridges;

(f) further manipulating product remaining in the tray to fall through the platform holes into the cartridges;

(g) removing the tray from the rack of cartridges; and then (h) closing tops of the cartridges by inserting plugs into the cartridges, and removing the cartridges from the rack, wherein a bottom end of the plug is disposed below the upper cartridge opening and inside the cartridge.

2. The method of claim 1 wherein, prior to step (g), further tamping the product in the cartridges.

3. The method of claim 2, wherein, prior to the further tamping, substantially clearing product from an upper surface of the platform, and wherein the further tamping step includes contacting the upper surface of the platform with a lower surface of a tamper.

4. The method of claim 3, wherein the tamper includes a plurality of extensions extending downward from the lower surface of the tamper, wherein the extensions include a distal axial length that extend into the cartridges at a predetermined depth relative to the cartridges and the platform during the further tamping step and the contacting the upper surface of the platform with the lower surface of the tamper.

5. The method of claim 1, wherein tamping comprises pushing the product further down into in the cartridges.

6. The method of claim 1 wherein, in steps (b) through (f), the platform holes in the tray substantially align with the respective upper cartridge openings ones of the cartridges.

7. The method of claim 1, further comprising substantially evenly distributing the selected amount of product to the cartridges.

8. The method of claim 1, wherein step (b) further comprises restraining upper and lower side portions of the cartridges with the rack.

9. The method of claim 1, wherein step (g) further comprises filling the cartridges with the product to a recessed fill level within the cartridges such that an upper level of the product in the cartridges is recessed relative to the upper cartridge opening and removing the tray from the rack of cartridges when the product is at the recessed fill level.

* * * * *